US010487788B2

(12) United States Patent
Hauser et al.

(10) Patent No.: US 10,487,788 B2
(45) Date of Patent: Nov. 26, 2019

(54) DETERMINING THE OPENING BEHAVIOR OF A FUEL INJECTOR BY MEANS OF AN ELECTRICAL TEST EXCITATION WITHOUT MAGNETIC SATURATION

(71) Applicant: CONTINENTAL AUTOMOTIVE GMBH, Hannover (DE)

(72) Inventors: Christian Hauser, Lappersdorf (DE); Michael Koch, Regensburg (DE); Robert Fromm, Donaustauf (DE); Gerd Rösel, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 76 days.

(21) Appl. No.: 14/360,817

(22) PCT Filed: Nov. 28, 2012

(86) PCT No.: PCT/EP2012/073873
§ 371 (c)(1),
(2) Date: May 27, 2014

(87) PCT Pub. No.: WO2013/079553
PCT Pub. Date: Jun. 6, 2013

(65) Prior Publication Data

US 2014/0345571 A1 Nov. 27, 2014

(30) Foreign Application Priority Data

Nov. 30, 2011 (DE) ..... 10 2011 087 418

(51) Int. Cl.
*F02M 65/00* (2006.01)

(52) U.S. Cl.
CPC ..... *F02M 65/005* (2013.01)

(58) Field of Classification Search
CPC ..... F02D 41/345; F02D 41/04; F02D 41/20; F02D 41/34; F02D 2041/2055;
(Continued)

(56) References Cited

U.S. PATENT DOCUMENTS 4,140,084 A * 2/1979 Di Nunzio ..... F02D 41/20 123/490
5,267,545 A * 12/1993 Kitson ..... H03K 17/166 123/490
(Continued)

FOREIGN PATENT DOCUMENTS

DE 2655615 A1 6/1977 ..... F02D 41/20
DE 19607073 A1 8/1997 ..... B60T 8/36
(Continued)

OTHER PUBLICATIONS

International Search Report and Written Opinion, Application No. PCT/EP2012/073873, 24 pages, dated Mar. 20, 2013.
(Continued)

*Primary Examiner* — Lindsay M Low
*Assistant Examiner* — Omar Morales
(74) *Attorney, Agent, or Firm* — Slayden Grubert Beard PLLC

(57) ABSTRACT

A method for determining an opening behavior of a combustion engine fuel injector having a coil drive includes: applying to a coil of the coil drive an electrical test excitation that is weaker than an electrical standard excitation applied to the coil during normal operation of the engine, such that an opening position of the fuel injector is achieved at a point at which the coil drive is not in magnetic saturation; measuring the chronological progression of an electrical variable of the coil; determining a first point in time at which the fuel injector reaches its opening position under the influence of the electrical test excitation, based on the measured chrono-
(Continued)

logical progression of the electrical variable, and determining a second point in time at which the fuel injector would reach its opening position under the influence of the electrical standard excitation, based on the determined first point in time.

11 Claims, 3 Drawing Sheets

(58) Field of Classification Search
CPC ..... F02D 2041/2058; F02D 2041/2062; F02D 2041/2051; F02M 65/00; F02M 65/005
USPC ..... 123/478, 490, 472; 701/105, 103; 361/154; 73/114.45, 114.47, 114.49
See application file for complete search history.

(56) References Cited

U.S. PATENT DOCUMENTS 5,892,649 A * 4/1999 Kahr ..... B60T 8/36 361/152
2009/0005955 A1* 1/2009 Askew ..... F02D 41/20 701/103
2009/0056676 A1* 3/2009 Nakata ..... F02D 41/221 123/478
2012/0234298 A1 9/2012 Jung ..... 123/478

FOREIGN PATENT DOCUMENTS

DE 19728840 A1 1/1999 ..... F02D 41/20
DE 102009045307 A1 4/2011 ..... F02D 41/20
DE 102009056289 A1 7/2011 ..... F02M 65/00
EP 1236880 A1 9/2002 ..... F02D 41/20
WO 2013/079553 A1 6/2013 ..... F02D 42/20

OTHER PUBLICATIONS

Chinese Office Action, Application No. 201280059253.5, 10 pages, dated Aug. 4, 2016.

* cited by examiner

DETERMINING THE OPENING BEHAVIOR OF A FUEL INJECTOR BY MEANS OF AN ELECTRICAL TEST EXCITATION WITHOUT MAGNETIC SATURATION

CROSS-REFERENCE TO RELATED APPLICATIONS

This application is a U.S. National Stage Application of International Application No. PCT/EP2012/073873 filed Nov. 28, 2012, which designates the United States of America, and claims priority to DE Application No. 10 2011 087 418.6 filed Nov. 30, 2011, the contents of which are hereby incorporated by reference in their entirety.

TECHNICAL FIELD

The present invention relates to the technical field of driving fuel injectors which have a magnetic armature, which is mechanically coupled to a valve needle, and a coil drive, which has a coil, for moving the magnetic armature. The present invention relates, in particular, to a method, to an apparatus and also to a computer program for determining an opening behavior of a fuel injector, which has a coil drive, for an internal combustion engine of a motor vehicle. The present invention further relates to a method for determining a correlation between a test opening behavior and a standard opening behavior of a fuel injector, which has a coil drive, for an internal combustion engine of a motor vehicle. The present invention also relates to a method for driving a fuel injector, which has a coil drive, in which method, amongst other things, the opening behavior over time of the fuel injector is used together with the above-described method for determining the opening behavior of a fuel injector.

BACKGROUND

It has long been known in motor vehicle engineering to optimize combustion processes in a combustion chamber of an internal combustion engine by using fuel injectors. In corresponding internal combustion engines with injection, it is possible, in comparison to internal combustion engines which have a carburetor, to realize a considerably better quantitative accuracy and possibly also a better spatial distribution of the fuel which is introduced into the respective combustion space or intake section.

Fuel injectors usually have a coil which generates a magnetic field when current is applied, it being possible for a magnetic armature to be moved from a closed position to an opening position against the force of a restoring spring by said magnetic field. A valve needle is fitted to the magnetic armature, said valve needle, when the magnetic armature is in the closed position, closing an injection opening in the fuel injector. When the magnetic armature is in the opening position, the injection opening is then opened by the valve needle and pressurized fuel can be output through the injection opening. In order to close the fuel injector, the application of current to the coil is stopped, and as a result the magnetic force on the armature is eliminated. The armature is moved back to its closed position by the remaining force of the restoring spring.

A known eddy current-driven coupling between the mechanism (armature and valve needle) and magnetic circuit (coil) of the fuel injector generates a feedback signal, which is based on the movement of the mechanism, in a known manner. In this case, a speed-dependent eddy current, which likewise causes a reaction on the magnetic circuit, is induced in the armature, which comprises a ferromagnetic material, as a result of the movement of the valve needle and of the armature. Therefore, a voltage, which is superimposed on the drive signal, is induced in the coil as a function of the movement speed of the armature and the valve needle.

It is further known that this effect, in the case of which a change in signal, which is impressed by the movement of the valve needle, is superimposed on the main electrical variable of voltage or current, can be further processed in such a way that the electrical component which is caused by the speed or, more precisely, by the change in the speed of the armature can be separated. In this case, in particular, a characteristic signal in the voltage or current signal is evaluated in respect of the time at which it occurs. Since the change in speed at the time at which the end position is reached is particularly large, it is possible to use this to determine the actual time at which the armature or the valve needle which is attached to the armature reaches the opening position.

In principle, the following methods are known for detecting a characteristic signal profile during the opening process:

(A) Current measurement: this requires the current profile to be actively influenced in order to ensure that the magnetic circuit is not in saturation. However, with this measurement method, a measurement signal first can be detected at full drive, that is to say at the mechanical stop of the valve needle.

(B) Voltage measurement: in this case, it is necessary for the coil to be driven using so-called sample & hold driving with a boost phase. In spite of this, it is generally not possible or at least very difficult, against the background of a relatively large drive voltage, to identify all of the required and typically relatively weak characteristics in the voltage which is applied to the coil and to evaluate them in respect of analysis of the armature movement.

The manufacture of fuel injectors is subject to tolerances. For example, in different fuel injectors, different spring forces and/or different levels of guide play (friction) can occur during opening and closing, said spring forces and levels of guide play in turn leading to different delay times and therefore to different injection quantities.

SUMMARY

One embodiment provides a method for determining an opening behavior of a fuel injector, which has a coil drive, for an internal combustion engine of a motor vehicle, the method comprising applying an electrical test excitation to a coil of the coil drive, said electrical test excitation being weaker than an electrical standard excitation which is applied to the coil during normal operation of the internal combustion engine, with the result that an opening position of the fuel injector is reached at a time at which the coil drive is not in magnetic saturation, measuring the time profile of an electrical variable of the coil, ascertaining a first time at which the fuel injector reaches its opening position under the influence of the electrical test excitation, based on the measured time profile of the electrical variable, and determining a second time at which the fuel injector would reach its opening position under the influence of the electrical standard excitation, based on the ascertained first time.

In a further embodiment, the electrical measurement variable is a current which is tapped off at the coil of the coil drive.

In a further embodiment, the second time is additionally determined based on a fuel pressure which is applied to the fuel injector.

In a further embodiment, both the test excitation and the standard excitation each have a boost phase, and wherein the test excitation differs from the standard excitation by virtue of a different time duration of the boost phase.

In a further embodiment, the second time is determined based on the ascertained first time using comparison data which is stored in a database.

In a further embodiment, a specific value for a counterforce is associated with the fuel injector based on (a) the ascertained first time, (b) the comparison data which is stored in the database, and/or (c) a time duration for a boost phase of the test excitation, said counterforce counteracting a magnetic force, which acts on a moving magnetic armature from the magnetic field of the excited coil, when the fuel injector is opened.

Another embodiment provides a method for determining a correlation between a test opening behavior and a standard opening behavior of a fuel injector, which has a coil drive, for an internal combustion engine of a motor vehicle, said method comprising applying an electrical test excitation to a coil of the coil drive, said electrical test excitation being so weak that an opening position of the fuel injector is reached at a time at which the coil drive is not magnetically saturated, measuring the time profile of a test throughflow rate of fuel through the fuel injector, ascertaining a first time at which the fuel injector reaches its opening position under the influence of the electrical test excitation, based on the measured time profile of the test throughflow rate of fuel, applying an electrical standard excitation to the coil of the coil drive, said electrical standard excitation being so strong that an opening position of the fuel injector is reached with magnetic saturation of the coil drive, measuring the time profile of a standard throughflow rate of fuel through the fuel injector, ascertaining a second time at which the fuel injector reaches its opening position under the influence of the electrical standard excitation, based on the measured time profile of the standard throughflow rate of fuel, and determining the correlation between the test opening behavior and the standard opening behavior, wherein the ascertained first time is compared with the ascertained second time.

Another embodiment provides a method for driving a fuel injector, which has a coil drive, for an internal combustion engine of a motor vehicle, said method comprising determining the opening behavior over time of the fuel injector according to any of the methods disclosed above, and adapting the electrical driving for the electrical standard excitation of the fuel injector based on the determined opening behavior over time, so that a predetermined quantity of fuel is injected with an injection process.

In a further embodiment, the method further comprises applying the electrical standard excitation to the coil of the coil drive, wherein the adapted electrical driving is used.

In a further embodiment, the electrical test excitation is applied to the coil and the electrical standard excitation is applied to the coil within a time period of less than one minute, and in particular within a time period of less than one second.

Another embodiment provides an apparatus for determining the opening behavior of a fuel injector, which has a coil drive, for an internal combustion engine of a motor vehicle, the apparatus having an excitation device for applying an electrical test excitation to a coil of the coil drive, said electrical test excitation being weaker than an electrical standard excitation which is applied to the coil during normal operation of the internal combustion engine, with the result that an opening position of the fuel injector is reached at a time at which the coil drive is not magnetically saturated, a measuring device for measuring the time profile of an electrical variable of the coil, and a data-processing device for ascertaining a first time at which the fuel injector reaches its opening position under the influence of the electrical test excitation, based on the measured time profile of the electrical variable, and for determining a second time at which the fuel injector would reach its opening position under the influence of the electrical standard excitation, based on the ascertained first time.

Another embodiment provides a computer program for determining an opening behavior of a fuel injector, which has a coil drive, for an internal combustion engine of a motor vehicle, wherein the computer program, when it is run by a processor, is designed to carry out any of the methods disclosed above.

BRIEF DESCRIPTION OF THE DRAWINGS

Example embodiments of the invention are discussed below with reference to the drawings, in which.

DETAILED DESCRIPTION

Figure 1:
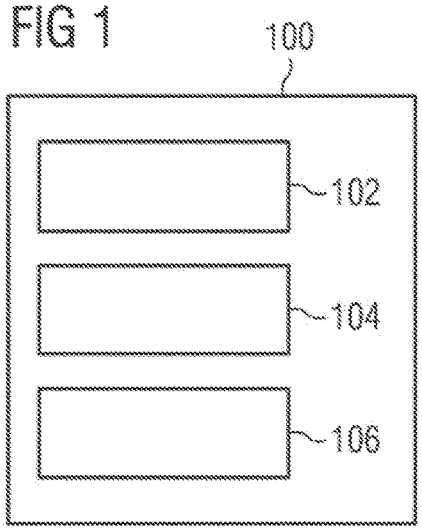
FIG. 1 shows an apparatus for determining the opening behavior of a fuel injector.

Embodiments of the present invention may improve the accuracy of actually injected quantities of fuel by virtue of improved determination of the actual movement behavior of a fuel injector.

A first aspect of the invention describes a method for determining an opening behavior of a fuel injector, which has a coil drive, for an internal combustion engine of a motor vehicle. The described method comprises (a) applying an electrical test excitation to a coil of the coil drive, said electrical test excitation being weaker than an electrical standard excitation which is applied to the coil during normal operation of the internal combustion engine, with the result that an opening position of the fuel injector is reached at a time at which the coil drive is not in magnetic saturation, (b) measuring the time profile of an electrical variable of the coil, (c) ascertaining a first time at which the fuel injector reaches its opening position under the influence of the electrical test excitation, based on the measured time profile of the electrical variable, and (d) determining a second time at which the fuel injector would reach its opening position under the influence of the electrical standard excitation, based on the ascertained first time.

The described method for determining the opening behavior is based on the knowledge that, by deliberately weaker electrical excitation of the coil of a coil drive of a fuel injector as part of a so-called test excitation, the profile of an electrical variable, which is characteristic of the opening behavior of the fuel injector and, in particular, of the opening position actually being reached under the influence of the test excitation which is weaker than a standard excitation, can be measured with a degree of accuracy which is sufficient in order to ascertain the exact (first) time at which the end position is reached (under the influence of the test excitation). In this case, it is critical that there is no magnetic saturation of the coil drive under the influence of the electrical test excitation at the time of detection since the first time can be ascertained with a sufficiently high degree of accuracy only in this case.

Based on the ascertained (first) time, it is possible to determine the expected (second) time at which the opening position will be reached with electrical standard excitation for the fuel injector in question, for example by comparison with the behavior of a reference fuel injector, in the case of which the time difference between the first time (at which the opening position is reached in the case of the electrical test excitation) and the second time (at which the opening position is reached in the case of the electrical standard excitation) was ascertained for example in a motor test bench under comparable conditions.

It should be noted that magnetic saturation can occur during the corresponding current profile in the case of the described test excitation too. However, it is critical for the described method for determining the opening behavior that the test excitation is so weak that there is (still) no magnetic saturation at the time at which the fuel injector reaches its opening position under the influence of the electrical test excitation.

The electrical test excitation and/or the electrical standard excitation are/is, in particular, a time profile of an excitation which can be a voltage which is applied to the coil and/or a current which flows through the coil.

In this connection, the term "weaker" and "relatively weak excitation" can be understood to mean, in particular, that the integral of the voltage which is applied to the coil with respect to time and/or the integral of the current which flows through the coil with respect to time is smaller than the corresponding integral with respect to time in the case of the standard excitation.

In this document, the expression "without magnetic saturation" can be understood to mean, in particular, that the magnetization of a magnetic and, in particular, a ferromagnetic element, such as a fitting or a so-called armature of the coil drive for example, is not magnetically saturated under the influence of the electrical test excitation. This means that a (further) increase in the electrical excitation of the coil leads at least to a certain (further) increase in the magnetization of the ferromagnetic element.

Therefore, when the test excitation which avoids magnetic saturation is applied to the fuel injector, it is possible to ensure that the electrical variable can be measured at the end of the movement of the armature or a valve needle, which is attached to the armature, of the fuel injector so accurately that a contribution to this variable can be determined, said contribution being based on a large change in speed which is associated with the opening position being reached.

The term "opening position" can be understood to mean, in particular, an end position of a valve needle of the fuel injector, said valve needle being mounted in the fuel injector in a displaceable manner. This end position can be defined, in particular, by a mechanical end stop.

The terms "first time" and "second time" can be considered to be, in particular, relative time information relating to a specific characteristic of the electrical test excitation or the electrical standard excitation. In this case, the characteristic in the test or the standard excitation can be any desired time in the corresponding excitation time profile. In particular, the characteristic can be the beginning of a so-called boost phase, during which an excessive excitation is applied to the coil of the fuel injector.

According to one exemplary embodiment of the invention, the electrical measurement variable is a current which is tapped off from the coil of the coil drive.

The tapped-off current can also contain, in particular, components which are induced in the solenoid on account of eddy currents which change over time, wherein these eddy currents, in turn, depend on the speed of the fitting, of the armature or of a valve needle of the fuel injector relative to a housing of the fuel injector. Since the opening position (of a valve needle) of a fuel injector is usually determined by a mechanical stop, sudden braking and therefore a large change in speed occur when said opening position is reached. This large change in speed in turn leads to strong eddy currents, with the result that the contribution to the change in current which is attributed to the eddy currents is correspondingly large and can be detected in a known manner and the actual time at which the opening position is reached under the influence of the electrical test excitation can be ascertained.

According to a further exemplary embodiment of the invention, the second time is additionally determined based on a fuel pressure which is applied to the fuel injector.

Since the actual opening behavior often depends to a considerable extent on the fuel pressure which is applied to the fuel injector, the second time at which the fuel injector would reach its opening position under the influence of the electrical standard excitation can be determined in a particularly accurate manner by taking into account the current fuel pressure.

According to a further exemplary embodiment of the invention, both the test excitation and the standard excitation each have a boost phase. Furthermore, the test excitation differs from the standard excitation by virtue of a different time duration of the boost phase.

The two excitations preferably differ only in respect of the duration of their boost phases. This has the advantage that a change can be made between the two various types of excitations in a simple manner. Complicated complete reconfiguration of a corresponding output drive stage is therefore not required in order to generate a test excitation from time to time during real operation of the fuel injector, on the basis of which it is then possible to determine the actual opening behavior of the fuel injector under the influence of the standard excitation.

In this connection, the term "boost phase" can be understood to mean any time period during the excitation of the coil within which the time gradient of an energy input into the coil has a particularly high positive value. In this case, the boost phase is based on the application of a so-called boost voltage which is increased by a suitable electrical boost circuit in relation to a voltage which is provided by a vehicle battery.

According to a further exemplary embodiment of the invention, the second time is determined based on the ascertained first time using comparison data which is stored in a database.

The comparison data can be, for example, analytical characteristic curves and/or characteristic curves which are stored in tables, said characteristic curves describing, for a reference fuel injector which has been accurately measured on a motor test bench for example, the relationship between the times at which the opening position is reached under the influence of the test excitation and the times at which the opening position is reached under the influence of the standard excitation. In this case, this relationship can also be stored in the database by a correspondingly large number of different characteristic curves depending on the fuel pressure which is applied to the fuel injector and/or depending on the boost duration in the case of the test excitation and/or in the case of the standard excitation.

The creation of said characteristic curves and/or, in the case of taking into account several dependencies, the creation of possibly multidimensional characteristic areas can be performed in various ways. In addition to the determination of the stop times with an instrumented fuel injector (on a motor test bench) already mentioned above, which determination can be performed by an evaluation of the electrical signal which is applied to the coil and/or by explicit measurement of injection rate profiles with in each case a conclusion about the movement of the valve needle, it is also possible to ascertain the stop times or the characteristic curves by suitable simulations.

According to a further exemplary embodiment of the invention, a specific value for a counterforce is associated with the fuel injector based on (a) the ascertained first time, (b) the comparison data which is stored in the database, and/or (c) a time duration for a boost phase of the test excitation, said counterforce counteracting a magnetic force, which acts on a moving magnetic armature from the magnetic field of the excited coil, when the fuel injector is opened.

Said counterforce can be a mechanical counterforce which is caused, in particular, by a force of a restoring spring of the fuel injector. However, this counterforce can also be a frictional force as a further component, said frictional force being produced in a bearing, in particular in a linear bearing, when the magnetic armature (together with the valve needle) moves in the direction of the opening position. Since a frictional force is always oriented back-to-back in parallel with a movement which causes the frictional force, said frictional force, together with the spring force of a restoring spring, makes a contribution to a decelerated opening movement when a fuel injector is opening.

The described association of a specific value for a spring force of this kind has the advantage that the respective fuel injector can be classified in an uncomplicated manner. Particularly simple and nevertheless accurate association between the two said times is possible as a result. In simple terms, this means that when the first time at which the fuel injector reaches its opening position under the influence of the electrical test excitation is known, it is possible to determine the second time at which the fuel injector would reach its opening position under the influence of the electrical standard excitation in a simple and nevertheless accurate manner.

A further aspect of the invention describes a method for determining a correlation between a test opening behavior and a standard opening behavior of a fuel injector, which has a coil drive, for an internal combustion engine of a motor vehicle. The described method comprises (a) applying an electrical test excitation to a coil of the coil drive, said electrical test excitation being so weak that an opening position of the fuel injector is reached at a time at which the coil drive is not magnetically saturated, (b) measuring the time profile of a test throughflow rate of fuel through the fuel injector, (c) ascertaining a first time at which the fuel injector reaches its opening position under the influence of the electrical test excitation, based on the measured time profile of the test throughflow rate of fuel, (d) applying an electrical standard excitation to the coil of the coil drive, said electrical standard excitation being so strong that an opening position of the fuel injector is reached with magnetic saturation of the coil drive, (e) measuring the time profile of a standard throughflow rate of fuel through the fuel injector, (f) ascertaining a second time at which the fuel injector reaches its opening position under the influence of the electrical standard excitation, based on the measured time profile of the standard throughflow rate of fuel, and (g) determining the correlation between the test opening behavior and the standard opening behavior, wherein the ascertained first time is compared with the ascertained second time.

The described method for determining a correlation between a test opening behavior and a standard opening behavior is based on the knowledge that characteristic curves can be determined by virtue of a large number of correlations which are determined in this way, said characteristic curves being suitable, in particular, for the above-described method for determining the opening behavior of a fuel injector which has a coil drive, in which method the second time is determined based on the ascertained first time using comparison data which is stored in a database. In this case, the comparison data represents the correlation or the characteristic curve which is determined by a large number of correlations.

The correlation determination method described here can be carried out, in particular, with a specific reference fuel injector on a motor test bench. In this case, it is advantageous when the reference fuel injector used is a fuel injector which has an average mechanical counterforce during the opening process in comparison to a large number of other fuel injectors of the same type. A fuel injector of this kind can be ascertained, for example, by a fuel injector of which the opening behavior corresponds approximately to the average opening behavior being selected under given conditions for various fuel injectors of the same type.

A further aspect of the invention describes a method for driving a fuel injector, which has a coil drive, for an internal combustion engine of a motor vehicle. Said method comprises (a) determining the opening behavior over time of the fuel injector using a method as described above, (b) adapting the electrical driving for the electrical standard excitation of the fuel injector based on the determined opening behavior over time, so that a predetermined quantity of fuel is injected with an injection process.

The described drive method is based on the knowledge that the above-explained method for determining the opening behavior over time of a fuel injector which has a coil drive can be used (a) to determine the expected actual movement behavior of a magnet armature or a valve needle, which is mechanically coupled to the magnet armature, of the fuel injector under the influence of the standard excitation, (b) to ascertain the actual injection quantity of fuel based on the determined movement behavior, and (c) to adapt the electrical driving of the fuel injector for a subsequent injection process under the influence of a standard excitation in such a way that the injection quantity of fuel corresponds as accurately as possible to a desired quantity which is prespecified for a specific operating state. In this case, the coil is electrically driven, in particular, by a possibly modified standard excitation, in the case of which it is ensured, as already described above, that magnetic saturation of the coil drive has been established at the latest by the time at which the opening position is reached.

In this case, the described adaptation of the electrical driving of the coil of the fuel injector can be calculated or determined, in particular, by the correlation, which is explained in detail above, between the test opening behavior and the standard opening behavior of the fuel injector.

According to one exemplary embodiment of the invention, the method further comprises applying the electrical standard excitation to the coil of the coil drive, wherein the adapted electrical driving is used.

The quantity accuracy of the fuel injector, in particular in the case of small quantities, can be considerably improved using this drive method, and therefore an important contribution can be made to a low fuel consumption and/or to reduced emissions of pollutants.

According to a further exemplary embodiment of the invention, the electrical test excitation is applied to the coil and the electrical standard excitation is applied to the coil within a time period of less than one minute, and in particular within a time period of less than one second. This has the advantage that the boundary conditions for the operation of the fuel injector do not change or at least do not substantially change within such a short time period, with the result that particularly accurate adaptation of the electrical driving for the electrical standard excitation of the fuel injector can be ensured.

In particular, the operating temperature of the entire fuel injector remains constant during such a short time period, with the result that, for example, the electrical parameters of the coil, such as the non-reactive resistance thereof or the inductance thereof, remain at least approximately the same. In this connection, it is noted that the inductance of the coil depends on the exact physical structure of the coil, which, on account of a thermal expansion, also depends on the temperature. Therefore, when the electrical parameters of the coil or of the entire coil drive remain at least approximately constant, the mechanical injector-to-injector tolerances at the respective measurement time and operating time are automatically compensated with a particularly high degree of accuracy using the described method.

It should be noted that, during real operation of the fuel injector, the described electrical test excitation should be used only comparatively rarely. This is because operation with the electrical test excitation cannot be carried out permanently since the opening speed of the fuel injector, which opening speed is reduced by the weaker test excitation, leads to a considerably lower injection quality (in particular injection quantity profile) in practice. In particular, undesired atomization can occur in the case of an electrical test excitation.

A further aspect of the invention describes an apparatus for determining the opening behavior of a fuel injector, which has a coil drive, for an internal combustion engine of a motor vehicle. The described apparatus, which can be realized in or by means of a motor control means in particular, has (a) an excitation device for applying an electrical test excitation to a coil of the coil drive, said electrical test excitation being weaker than an electrical standard excitation which is applied to the coil during normal operation of the internal combustion engine, with the result that an opening position of the fuel injector is reached without magnetic saturation of the coil drive, (b) a measuring device for measuring the time profile of an electrical variable of the coil, and (c) a data-processing device for (c1) ascertaining a first time at which the fuel injector reaches its opening position under the influence of the electrical test excitation, based on the measured time profile of the electrical variable, and for (c2) determining a second time at which the fuel injector would reach its opening position under the influence of the electrical standard excitation, based on the ascertained first time.

The described apparatus is also based on the knowledge that, by deliberately weaker electrical excitation of the coil of a coil drive of a fuel injector as part of a so-called test excitation, the profile of an electrical variable, which is characteristic of the opening behavior of the fuel injector under the influence of the relatively weak test excitation, can be measured with a degree of accuracy which is sufficient in order to ascertain the exact (first) time at which the end position is reached (under the influence of the test excitation). In this case, it is critical that there is no magnetic saturation of the coil drive under the influence of the electrical test excitation since the electrical variable can generally be measured with a sufficient degree of accuracy only in this case, this in turn representing the critical prerequisite for accurately ascertaining the first time.

A further aspect of the invention describes a computer program for determining an opening behavior of a fuel injector, which has a coil drive, for an internal combustion engine of a motor vehicle. The computer program, when it is run by a processor, is designed to carry out the above-described method for determining an opening behavior of a fuel injector which has a coil drive.

Within the meaning of this document, the designation of such a computer program has the same meaning as the term a program element, a computer program product and/or a computer-readable medium which contains instructions for controlling a computer system in order to coordinate the operation of a system or a method in a suitable manner in order to achieve the effects associated with the disclosed method.

The computer program can be implemented as a computer-readable instruction code in any suitable programmable language such as, for example, JAVA, C++ etc. The computer program can be stored on a computer-readable storage medium (CD-Rom, DVD, Blue-ray disk, removable drive, volatile or nonvolatile memory, installed memory or processor etc.). The instruction code can program a computer or other programmable appliances such as, in particular, a control device for a motor of a motor vehicle in such a way that the desired functions are implemented. In addition, the computer program can be provided in a network such as the Internet, for example, from where it can be downloaded by a user as required.

The invention can be realized both by means of a computer program, that is to say software, and by means of one or more special electrical circuits, that is to say using hardware or any desired hybrid form, that is to say by means of software components and hardware components.

It is noted that embodiments of the invention have been described with reference to different subjects of the invention. In particular, some embodiments of the invention are described with apparatus claims and other embodiments of the invention are described with method claims. However, it will be immediately clear to a person skilled in the art when reading this application that, where not explicitly specified otherwise, any desired combination of features which belong to different types of subjects of the invention is also possible, in addition to a combination of features which belong to a type of subject matter according to the invention.

It should be noted that the embodiments described in the text which follows merely represent a limited selection of possible variant embodiments of the invention. In particular, it is possible to combine the features of individual embodiments with one another in a suitable manner, with the result that a large number of different embodiments can be considered to be disclosed in an obvious manner for a person skilled in the art by the variant embodiments explicitly illustrated here.

FIG. 1 shows an apparatus 100 for determining the opening behavior of a fuel injector, which has a coil drive, for an internal combustion engine of a motor vehicle. The apparatus 100 has an excitation device 102 for applying an electrical test excitation to a coil of the coil drive, said electrical test excitation being weaker than an electrical standard excitation which is applied to the coil during normal operation of the internal combustion engine, with the result that an opening position of the fuel injector is reached at a time at which the coil drive is not magnetically saturated. The apparatus also has a measuring device 104 for measuring the time profile of an electrical variable of the coil and has a data-processing device 106. The data-processing device 106 serves (a) to ascertain a first time at which the fuel injector reaches its opening position under the influence of the electrical test excitation, based on the measured time profile of the electrical variable, and (b) to determine a second time at which the fuel injector would reach its opening position under the influence of the electrical standard excitation, based on the ascertained first time.

Figure 2:
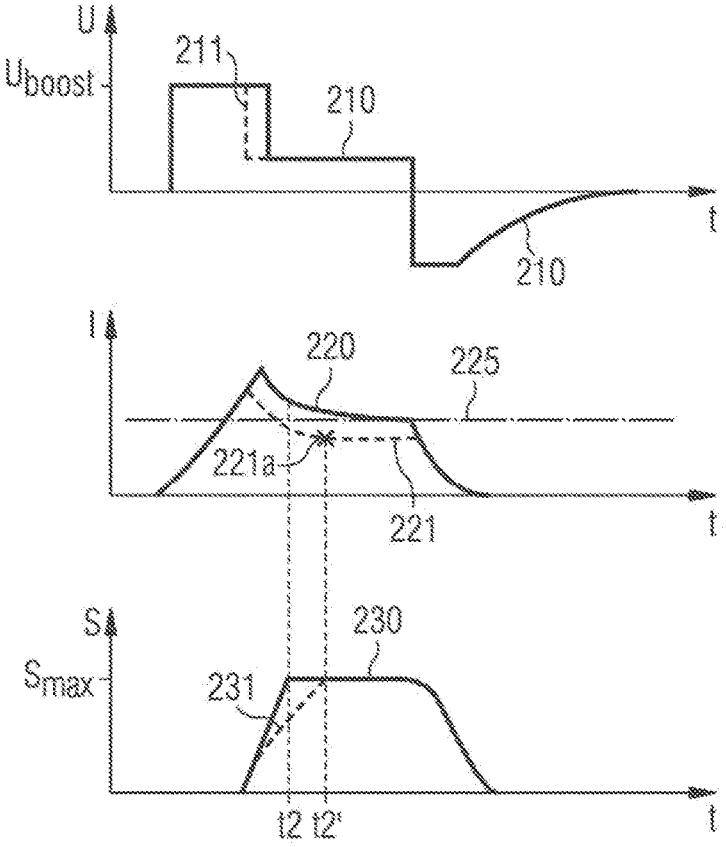
FIG. 2 shows a comparison between a standard excitation profile and a test excitation profile.

FIG. 2 shows a comparison between a standard excitation profile and a test excitation profile. A voltage U which is applied to the coil of a fuel injector is shown as a function of the time t in the top graph, the intensity of a corresponding current I which flows through the coil is shown in the middle graph, and the resulting time profile of the travel s of a valve needle of the fuel injector is shown in the bottom graph.

A series excitation is shown using solid lines which are provided with reference signs 210 and 220. In this case, line 210 represents the voltage profile of the series excitation, and line 220 represents the corresponding current profile of the series excitation. A test excitation is shown, at least in regions where it differs from the series excitation, by dashed lines which are provided with reference signs 211 and 221. In this case, line 211 represents the voltage profile of the test excitation, and line 221 represents the corresponding current profile in the case of this series excitation.

As can be seen in FIG. 2, according to the exemplary embodiment illustrated here, the voltage profile 211 of the test excitation differs from the voltage profile 210 of the series excitation only in the time period of a boost phase. Within this boost phase, a boost voltage Uboost is applied in a known manner for the purpose of opening the fuel injector as quickly as possible.

The horizontal line which is shown in the middle graph by means of a dashed-and-dotted line 225 illustrates the limit starting from which magnetic saturation occurs. Magnetic saturation is present in the region above this saturation limit 225; there is no magnetic saturation beneath said saturation limit 225. As a result, as can be seen in the bottom graph of FIG. 2, there is magnetic saturation at time t2 at which the maximum valve travel smax is reached in the case of the series excitation (cf. profile 230 of a needle travel in the case of the series excitation). In contrast to this, there is no magnetic saturation at a later time t2' at which the maximum valve travel smax is reached in the case of the test excitation (cf. profile 231 of a needle travel in the case of the test excitation). As already explained in detail above, the situation of the opening position being reached, which corresponds to the needle travel smax, can be identified at the point of the curve 221, which point is marked by reference sign 221*a*, on the basis of accurate analysis of the current which is tapped off from the coil.

According to a preferred exemplary embodiment, the situation of the opening position being reached is identified by a suitable test excitation being applied to the coil of the fuel injector at at least one operating point which is determined by a specific fuel pressure fup and then by transferring the identified value to an operating region with a standard excitation.

Figure 3:
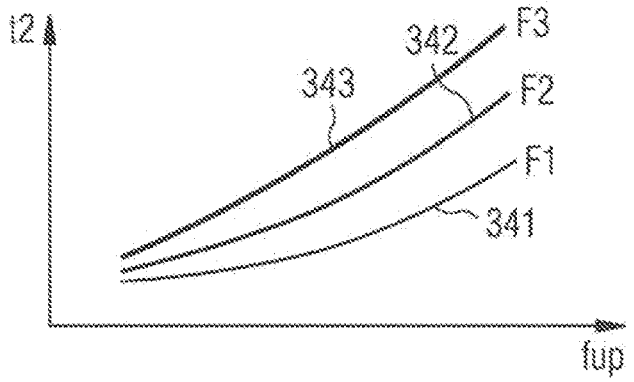
FIG. 3 shows simulation results for the opening behavior of three different fuel injectors with different spring forces depending on a fuel pressure which is applied to the respective fuel injector.

FIG. 3 shows simulation results for three different fuel injectors with different spring forces F1, F2 and F3, wherein: F1<F2<F3. The time t2 at which the opening position is reached (needle stop) is shown depending on the fuel pressure (fup) and the different spring forces F1, F2 and F3. The corresponding curves, which represent characteristic curves, are identified by reference signs 341, 342 and 343. As can be seen in FIG. 3, different counterforces are simulated by the various spring forces. Said counterforces can contain still further variable components, such as frictional forces for example.

It can be seen in FIG. 3 that the highest spring force F3 inhibits the opening movement of the valve needle to the greatest extent, with the result that the highest values for the respective time t2 of the needle stop are produced for the spring force F3.

It can further be seen in FIG. 3 that all of the fuel injectors are described by at least approximately similar curves. If a point in the fup-t2 graph is now known, conclusions can then also be drawn about all of the other points. This can be done, for example, by storing said curves 341, 342 and 343, which represent characteristic curves, in tables. As an alternative, these characteristic curves 341, 342 and 343 can also be described by suitable parameterization.

Transferring a detection value for the time t2 of the needle stop from test operation with a test excitation to normal operation with a standard excitation can be particularly accurate when a corresponding characteristic curve table is further extended by the time period tboost of the boost phase. According to the exemplary embodiment illustrated here, the time period tboost is, specifically, the essential feature for distinguishing between the test excitation and the standard excitation. A short time period tboost corresponds to a test excitation, a longer time period tboost corresponds to a standard excitation.

Figure 4:
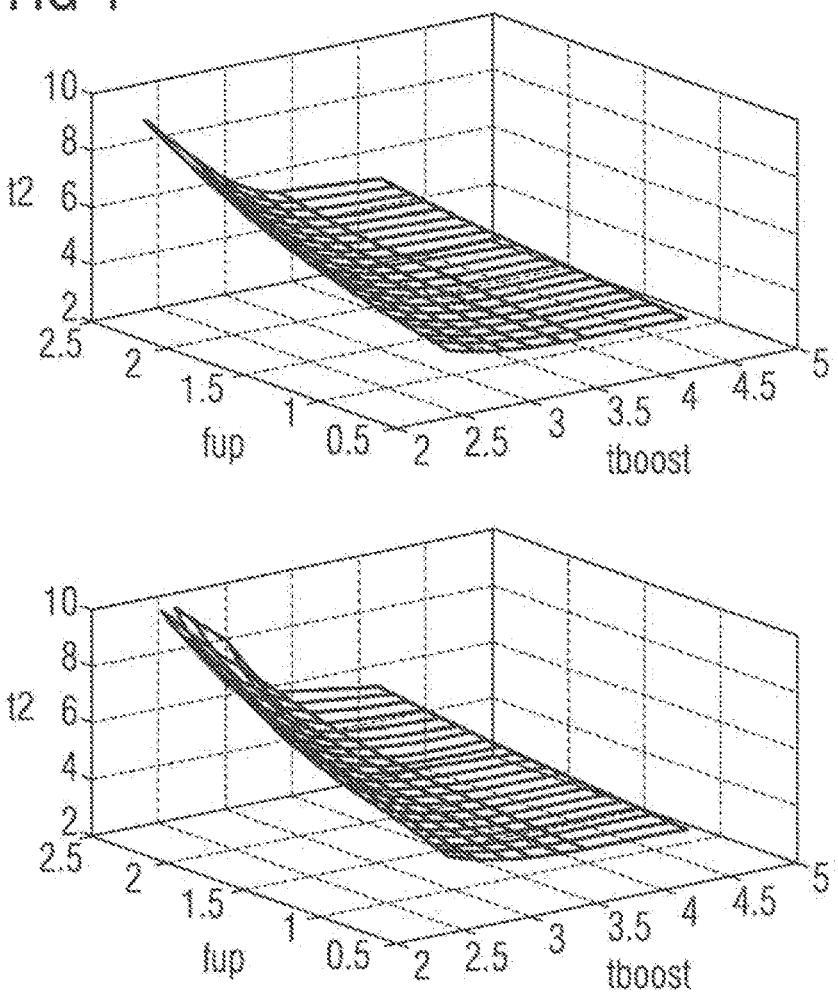
FIG. 4 shows, for two different fuel injectors, characteristic areas for the dependency of the opening behavior over time (a) on a fuel pressure which is applied to the respective fuel injector, and (b) on a duration of a boost phase.

FIG. 4 shows, for two different fuel injectors, corresponding characteristic areas for the dependency of the opening behavior over time (a) on the fuel pressure which is applied to the respective fuel injector, and (b) on the time period tboost of a boost phase. The fuel pressure fup is plotted in the unit $10^5$ hectopascals. The time period tboost is plotted in the unit $10^{-4}$ seconds. The time t2 of the needle stop is likewise plotted in the unit $10^{-4}$ seconds.

The two fuel injectors differ in respect of the counterforce which inhibits or decelerates the needle movement, in particular by the spring during an opening movement. In this case too, conclusions can be drawn from one point about all of the other points by storing the values in tables or by suitable parameterization of the areas.

If driving is performed with the test excitation close to various operating points in respect of time, it can then be assumed that the operating temperature of the fuel injector has not changed. In this case, the electrical parameters of the coil drive, such as the non-reactive resistance of the coil and the inductance of the coil (no thermal expansion) for example, remain the same and only the mechanical tolerances are measured. As a result, electrical influences and mechanical influences on the opening behavior of the fuel injector can be separated from one another.

Figure 5:
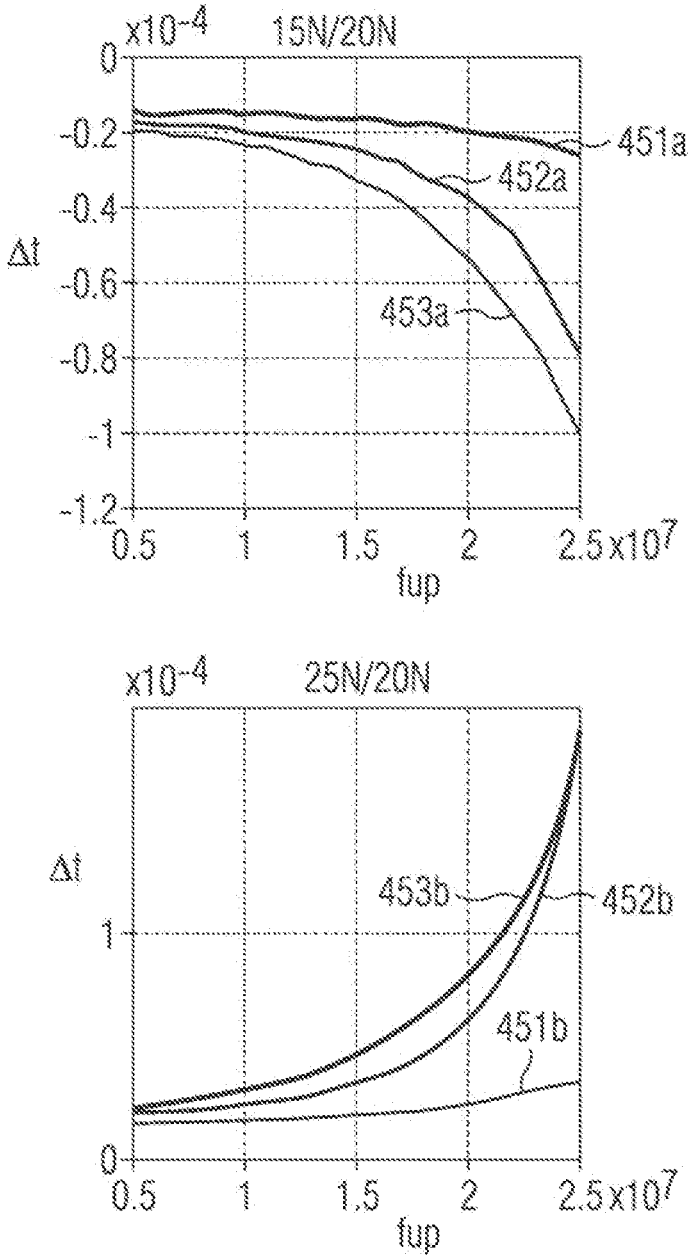
FIG. 5 shows, for three different durations of a boost phase, the characteristic curves for two fuel injectors with a spring force of 15 N and, respectively, 25 N based on a reference fuel injector with a spring force of 20 N.

FIG. 5 shows, for three different durations tboost of a boost phase, the characteristic curves for two fuel injectors with a spring force of 15 N and, respectively, 25 N based on a reference fuel injector with a spring force of 20 N. The fuel pressure is plotted in the unit $10^5$ hectopascals on the abscissa. The difference Δt between (a) the opening time t2 of the fuel injector with the spring force 15 N (left-hand side) and, respectively, with the spring force 25 N (right-hand side) and (b) the opening time t2 of the reference fuel injector with the spring force 20 N is plotted on the ordinate in the unit $10^{-4}$ seconds.

Reference signs 451*a* and 451*b* represent the corresponding profiles of Δt for an excitation with a time period tboost of 415 μs (=$415\times10^{-6}$ seconds). According to the exemplary embodiment illustrated here, a time period tboost of 415 μs corresponds to an electrical standard excitation. Reference signs 452*a* and 452*b* represent the corresponding profiles of Δt for an excitation with a time period tboost of 300 μs. Reference signs 453*a* and 453*b* represent the corresponding profiles of Δt for an excitation with a time period tboost of 280 μs.

Since, according to the exemplary embodiment illustrated here, the injector with a spring force or with a counterforce of 20 N is defined as a reference fuel injector, the spring forces of different fuel injectors can be determined on the basis of the characteristic profiles of characteristic curves. This can be performed in the manner described as follows:

(1) When a test excitation is applied to the fuel injector in question, the time t2' of the needle stop is initially determined on the basis of an accurate evaluation of the current which is tapped off from the coil of the fuel injector. (2) The corresponding value for the reference fuel injector with the same test excitation is then read off from a stored table. (3) The difference Δt between the determined value t2' and the corresponding value for the reference fuel injector is then calculated. (4) Furthermore, the current fuel pressure fup is measured. (5) A point is defined in the left-hand graph and, respectively, in the right-hand graph of FIG. 5 for the difference Δt using the measured fuel pressure fup and the calculated value. (6) After the detection is carried out at several operating points, that curve which is stored in a database and runs through these points is then sought. This curve is then a measure of the counterforce of the spring (and friction) of the fuel injector in question.

In summary, it is clear that:

(A) The method described in this document can be used, under the influence of a test excitation, to identify the time t2' at which the opening position (needle stop) of a fuel injector is reached at at least one operating point which can be determined, inter alia, by the fuel pressure.

(B) Said identified time t2' can be used to draw conclusions about the needle stop which would be produced under the influence of the electrical standard excitation.

(C) Since the time of the needle stop in the case of the standard excitation is therefore known, the opening behavior of all of the fuel injectors in an internal combustion engine can be coordinated by a suitable control strategy.

(D) As a result, improved driving of fuel injectors can be achieved, for example, in respect of a desired linear dependency between (i) the time period of the excitation of the coil of the fuel injector in question, and (ii) the quantity of fuel actually injected.

LIST OF REFERENCE SIGNS

100 Apparatus for determining the opening behavior over time of a fuel injector
102 Excitation device
104 Measuring device
106 Data-processing device
210 Voltage profile of a series excitation
211 Voltage profile of a test excitation
220 Current profile of a series excitation
221 Current profile of a test excitation
221*a* Excitation state with the possibility of identification of the situation of the opening position being reached
225 Saturation limit
230 Needle travel in the case of series excitation
231 Needle travel in the case of test excitation
I Current flowing through the coil
s Travel of the valve needle
t Time
t2' Time at which the maximum valve travel is reached in the case of the test excitation
t2 Time at which the maximum valve travel is reached in the case of the series excitation
smax Maximum valve travel
t Time
U Voltage which is applied to the coil
Uboost Boost voltage
341 Characteristic curve for the first spring force F1
342 Characteristic curve for the second spring force F2
343 Characteristic curve for the third spring force F3
fup Fuel pressure
451*a/b* Difference Δt in respect of the opening time (time of the needle stop) for two different fuel injectors for a boost duration of 415 μs
452*a/b* Difference Δt in respect of the opening time (time of the needle stop) for two different fuel injectors for a boost duration of 300 μs
453*a/b* Difference Δt in respect of the opening time (time of the needle stop) for two different fuel injectors for a boost duration of 280 μs

The invention claimed is:

1. A method for determining an opening behavior of a fuel injector of an internal combustion engine of a motor vehicle, the fuel injector having a coil drive, the method comprising:

applying an electrical test excitation to a coil of the coil drive, said electrical test excitation including a voltage profile with a shorter duration of peak voltage and an equivalent total duration in comparison to an electrical standard excitation applied to the coil during normal operation of the internal combustion engine, such that a fully open position of the fuel injector is reached at a time at which the coil drive is not in magnetic saturation, measuring a time profile of an electrical variable of the coil, determining a first time at which the fuel injector reaches the fully open position under the influence of the electrical test excitation, based on the measured time profile of the electrical variable, and determining a second time at which the fuel injector would reach the fully open position under the influence of the electrical standard excitation, based on the ascertained first time, wherein both the test excitation and the standard excitation each include a respective boost phase, and the test excitation differs from the standard excitation at least by a different time duration of the respective boost phases.

2. The method of claim 1, wherein the electrical measurement variable is a current that is tapped off at the coil of the coil drive.

3. The method of claim 1, wherein the second time is determined based on the ascertained first time and a fuel pressure applied to the fuel injector.

4. The method of claim 1, wherein the second time is determined based on the ascertained first time using comparison data stored in a database.

5. The method of claim 4, wherein a specific value for a counterforce is associated with the fuel injector based on at least one of:

(a) the ascertained first time, (b) the comparison data stored in the database, and (c) a time duration for a boost phase of the test excitation, wherein said counterforce counteracts a magnetic force that acts on a moving magnetic armature from a magnetic field of the excited coil when the fuel injector is opened.

6. A method for determining a correlation between a test opening behavior and a standard opening behavior of a fuel injector of an internal combustion engine of a motor vehicle, the fuel injector having a coil drive, for, said method comprising:

applying an electrical test excitation to a coil of the coil drive, said electrical test excitation including a voltage profile with a shorter duration of peak voltage and an equivalent total duration in comparison to an electrical standard excitation such that that a fully open position of the fuel injector is reached at a time at which the coil drive is not magnetically saturated, measuring a time profile of a test throughflow rate of fuel through the fuel injector, determining a first time at which the fuel injector reaches the fully open position under the influence of the electrical test excitation, based on the measured time profile of the test throughflow rate of fuel, applying an electrical standard excitation to the coil of the coil drive, said electrical standard excitation being sufficiently strong that the fully open position of the fuel injector is reached with magnetic saturation of the coil drive, measuring a time profile of a standard throughflow rate of fuel through the fuel injector, determining a second time at which the fuel injector reaches the fully open position under the influence of the electrical standard excitation, based on the measured time profile of the standard throughflow rate of fuel, and determining a correlation between the test opening behavior and the standard opening behavior, wherein the determined first time is compared with the ascertained second time, wherein both the test excitation and the standard excitation each include a respective boost phase, and the test excitation differs from the standard excitation at least by a different time duration of the respective boost phases.

7. A method for driving a fuel injector of an internal combustion engine of a motor vehicle, the fuel injector having a coil drive, said method comprising:

determining an opening behavior over time of the fuel injector by performing a method comprising:

applying an electrical test excitation to a coil of the coil drive, said electrical test excitation including a voltage profile with a shorter duration of peak voltage and an equivalent total duration in comparison to an electrical standard excitation such that than an electrical standard excitation applied to the coil during normal operation of the internal combustion engine, such that a fully open position of the fuel injector is reached at a time at which the coil drive is not in magnetic saturation, measuring a time profile of an electrical variable of the coil, determining a first time at which the fuel injector reaches the fully open position under the influence of the electrical test excitation, based on the measured time profile of the electrical variable, and determining a second time at which the fuel injector would reach the fully open position under the influence of the electrical standard excitation, based on the ascertained first time; and adapting the electrical driving for the electrical standard excitation of the fuel injector based on the determined opening behavior over time, such that a predetermined quantity of fuel is injected with an injection process, wherein both the test excitation and the standard excitation each include a respective boost phase, and the test excitation differs from the standard excitation at least by a different time duration of the respective boost phases.

8. The method of claim 7, further comprising applying the electrical standard excitation to the coil of the coil drive, wherein the adapted electrical driving is used.

9. The method of claim 8, wherein the electrical test excitation is applied to the coil and the electrical standard excitation is applied to the coil within a time period of less than one minute.

10. The method of claim 8, wherein the electrical test excitation is applied to the coil and the electrical standard excitation is applied to the coil within a time period of less than one second.

11. An apparatus for determining the opening behavior of a fuel injector of an internal combustion engine of a motor vehicle, the fuel injector having a coil drive, the apparatus comprising:

an excitation device configured to apply an electrical test excitation to a coil of the coil drive, said electrical test excitation including a voltage profile with a shorter duration of peak voltage and an equivalent total duration in comparison to an electrical standard excitation such that than an electrical standard excitation applied to the coil during normal operation of the internal combustion engine, such that a fully open position of the fuel injector is reached at a time at which the coil drive is not magnetically saturated, a measuring device configured to measure a time profile of an electrical variable of the coil, and a data-processing device programmed to:

determine a first time at which the fuel injector reaches the fully open position under the influence of the electrical test excitation, based on the measured time profile of the electrical variable, and determine a second time at which the fuel injector would reach the fully open position under the influence of the electrical standard excitation, based on the ascertained first time, wherein both the test excitation and the standard excitation each include a respective boost phase, and the test excitation differs from the standard excitation at least by a different time duration of the respective boost phases.

* * * * *